US012157203B2

(12) United States Patent
Lee et al.

(10) Patent No.: US 12,157,203 B2
(45) Date of Patent: Dec. 3, 2024

(54) GRINDING WHEEL FOR GRINDING

(71) Applicants: Hyundai Motor Company, Seoul (KR); Kia Corporation, Seoul (KR)

(72) Inventors: In Sun Lee, Ulsan (KR); Hee Hyun Kim, Ulsan (KR); Kwang Won Sung, Ulsan (KR); Sang Won Lim, Seoul (KR)

(73) Assignees: HYUNDAI MOTOR COMPANY, Seoul (KR); KIA CORPORATION, Seoul (KR)

( * ) Notice: Subject to any disclaimer, the term of this patent is extended or adjusted under 35 U.S.C. 154(b) by 552 days.

(21) Appl. No.: 17/449,691

(22) Filed: Oct. 1, 2021

(65) Prior Publication Data

US 2022/0219290 A1 Jul. 14, 2022

(30) Foreign Application Priority Data

Jan. 14, 2021 (KR) ..... 10-2021-0005075

(51) Int. Cl.
*B24D 5/02* (2006.01)
*B24D 3/20* (2006.01)

(52) U.S. Cl.
CPC ..... *B24D 5/02* (2013.01); *B24D 3/20* (2013.01)

(58) Field of Classification Search
CPC ... B24D 5/02; B24D 5/04; B24D 5/08; B24D 5/12; B24D 7/04; B24D 3/00; B24D 3/20
See application file for complete search history.

(56) References Cited

U.S. PATENT DOCUMENTS 5,645,476 A * 7/1997 Meyer ..... B24D 5/00 51/297
2003/0194954 A1 10/2003 Bonner

FOREIGN PATENT DOCUMENTS

JP H07 164328 * 6/1995 ..... B24D 7/00

* cited by examiner

*Primary Examiner* — Pegah Parvini
(74) *Attorney, Agent, or Firm* — MCDONNELL BOEHNEN HULBERT & BERGHOFF LLP

(57) ABSTRACT

The present disclosure provides a grinding wheel for grinding, configured such that a fiber-reinforced plastic (FRP) layer in a wheel outer peripheral part located on the outer surface of a wheel central part is provided at a position and thickness that vary depending on the type of weaving pattern layer, thereby exhibiting superior mechanical properties and superior vibration/shock absorption and offsetting effects compared to conventional grinding wheels, so problems such as cracking and fatigue failure due to burning do not occur, and moreover, the quality and productivity of processed products can be improved. Moreover, the grinding wheel is lighter in weight than conventional grinding wheels, and when an abrasive part is completely consumed, it can be replaced with a new abrasive part through removable attachment thereof, whereby the wheel outer peripheral part (wheel body) can be reused continuously, and the exchange time and the amount of tool wear can be reduced.

12 Claims, 2 Drawing Sheets

GRINDING WHEEL FOR GRINDING

CROSS-REFERENCE TO RELATED APPLICATIONS

This application claims under 35 U.S.C. § 119(a) the benefit of priority from Korean Patent Application No. 10-2021-0005075, filed on Jan. 14, 2021, the entire contents of which are incorporated herein by reference.

TECHNICAL FIELD

The present disclosure relates to a grinding wheel for grinding.

BACKGROUND

In general, concrete, asphalt, various blocks and refractories, as well as stone materials such as marble, are subjected to primary processing and then secondary finishing for smooth trimming by removing fine protrusions or scratches remaining on the surface thereof. Here, a grinding wheel for grinding is mainly used. In particular, when processing a crank including a pin or journal, fine processing is required, and roughness and quality must be consistent, so grinding is performed using a grinding wheel.

However, a grinding wheel for crank processing is made of steel and is thus heavy, so there is a problem in that the exchange time is increased due to the need to use a crane or a forklift when replacing the wheel, and the use of the grinding wheel made of steel is problematic in that cracking and fatigue failure may occur due to burning on the surface of the material of a pin or journal.

Accordingly, it is necessary to develop a grinding wheel that is able to decrease the tool wear rate, thereby reducing the cost of tools and improving manufacturing efficiency and productivity.

SUMMARY

Therefore, the present disclosure has been made keeping in mind the problems encountered in the related art, and specific objectives thereof are as follows.

The present disclosure is intended to provide a grinding wheel that includes a wheel central part including steel and a wheel outer peripheral part provided on the outer surface of the wheel central part and configured such that a fiber-reinforced plastic (FRP) layer is laminated and joined in a plurality of plies in a direction perpendicular to the outer surface of the wheel central part, the fiber-reinforced plastic (FRP) layer having at least one weaving pattern layer selected from among a woven fabric layer and a unidirectional fabric layer, and the weaving pattern layer being laminated in a predetermined thickness range and in a predetermined lamination direction.

The objectives of the present disclosure are not limited to the foregoing, and will be able to be clearly understood through the following description and to be realized by the means described in the claims and combinations thereof.

In one aspect, the present disclosure provides a grinding wheel, which includes a wheel central part including steel, and a wheel outer peripheral part provided on the outer surface of the wheel central part and configured such that a fiber-reinforced plastic (FRP) layer is laminated and joined in a plurality of plies in a direction perpendicular to the outer surface of the wheel central part, the fiber-reinforced plastic (FRP) layer having at least one weaving pattern layer selected from among a woven fabric layer and a unidirectional fabric layer.

The fiber-reinforced plastic layer may include at least one selected from the group consisting of carbon-fiber-reinforced plastic (CFRP), glass-fiber-reinforced plastic (GFRP), and aramid-fiber-reinforced plastic (AFRP).

The fiber bundle of the fiber-reinforced plastic layer may be composed of 1 k to 24 k strands of yarn per ply.

The wheel outer peripheral part may be configured such that a core portion parallel to a line perpendicular to the outer surface of the wheel central part and located at the center of the wheel outer peripheral part, a middle portion parallel to the core portion and located on at least one side of the core portion, and a surface portion located on the middle portion are laminated and joined.

Each of the core portion and the surface portion may include a woven fabric layer having a plurality of plies.

The thickness in plies of the core portion may be 8 to 12 plies.

The thickness in plies of the surface portion may be 22 to 28 plies.

The woven fabric layer may be a woven fabric layer interlaced in 0° and 90° directions.

The woven fabric layer may be woven in a plain weave.

The middle portion may include a unidirectional fabric layer having a plurality of plies.

The thickness in plies of the unidirectional fabric layer may be 90 to 100 plies.

The unidirectional fabric layer may be laminated at an intersection angle of 85° to 95° to form a plurality of plies.

The grinding wheel may further include an abrasive part provided on the outer surface of the wheel outer peripheral part and including an abrasive.

According to the present disclosure, the grinding wheel is configured such that the fiber-reinforced plastic layer (FRP) in the wheel outer peripheral part located on the outer surface of the wheel central part is provided at a position and thickness varying depending on the type of weaving pattern layer, thus exhibiting superior mechanical properties and vibration/shock absorption and offsetting effects compared to conventional grinding wheels, so it not only avoids problems such as cracking and fatigue failure due to burning, but also improves the quality and productivity of processed products and is lighter in weight than conventional grinding wheels. Unlike conventional grinding wheels, when the abrasive part is completely consumed, it can be replaced with a new abrasive part through removable attachment thereof, whereby the wheel outer peripheral part (wheel body) can be reused continuously, and the exchange time and the amount of tool wear can be reduced.

The effects of the present disclosure are not limited to the foregoing, and should be understood to include all effects that can be reasonably anticipated from the following description.

BRIEF DESCRIPTION OF THE DRAWINGS

The above and other features of the present disclosure will now be described in detail with reference to certain exemplary embodiments thereof illustrated in the accompanying drawings which are given hereinbelow by way of illustration only, and thus are not limitative of the present disclosure, and wherein.

DETAILED DESCRIPTION

Figure 1:
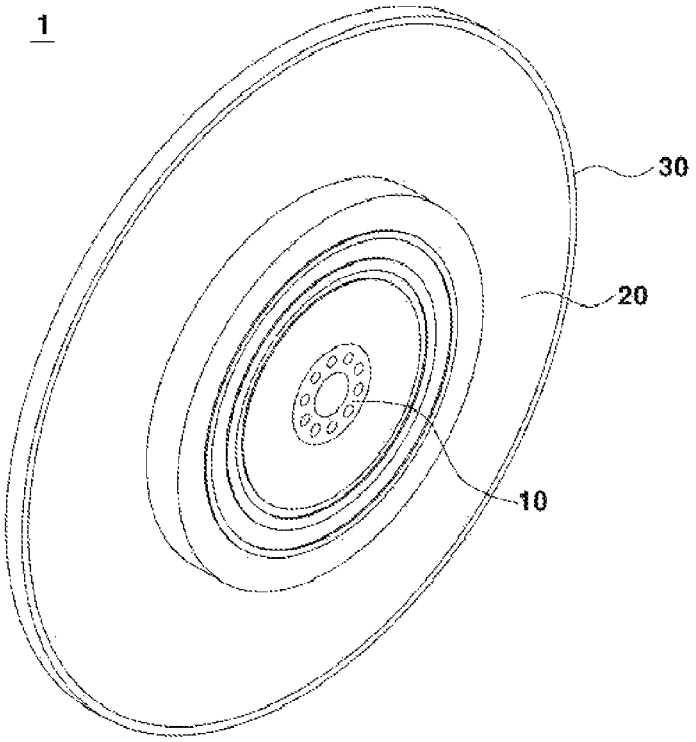
FIG. 1 is a perspective view showing a grinding wheel according to the present disclosure.

The above and other objectives, features and advantages of the present disclosure will be more clearly understood from the following preferred embodiments taken in conjunction with the accompanying drawings. However, the present disclosure is not limited to the embodiments disclosed herein, and may be modified into different forms. These embodiments are provided to thoroughly explain the disclosure and to sufficiently transfer the spirit of the present disclosure to those skilled in the art.

Throughout the drawings, the same reference numerals will refer to the same or like elements. For the sake of clarity of the present disclosure, the dimensions of structures are depicted as being larger than the actual sizes thereof.

It will be further understood that the terms "comprise", "include", "have", etc., when used in this specification, specify the presence of stated features, integers, steps, operations, elements, components, or combinations thereof, but do not preclude the presence or addition of one or more other features, integers, steps, operations, elements, components, or combinations thereof. Also, it will be understood that when an element such as a layer, film, area, or sheet is referred to as being "on" another element, it can be directly on the other element, or intervening elements may be present therebetween. Similarly, when an element such as a layer, film, area, or sheet is referred to as being "under" another element, it can be directly under the other element, or intervening elements may be present therebetween.

Unless otherwise specified, all numbers, values, and/or representations that express the amounts of components, reaction conditions, polymer compositions, and mixtures used herein are to be taken as approximations including various uncertainties affecting measurement that inherently occur in obtaining these values, among others, and thus should be understood to be modified by the term "about" in all cases. Furthermore, when a numerical range is disclosed in this specification, the range is continuous, and includes all values from the minimum value of said range to the maximum value thereof, unless otherwise indicated. Moreover, when such a range pertains to integer values, all integers including the minimum value to the maximum value are included, unless otherwise indicated.

In the present specification, when a range is described for a variable, it will be understood that the variable includes all values including the end points described within the stated range. For example, the range of "5 to 10" will be understood to include any subranges, such as 6 to 10, 7 to 10, 6 to 9, 7 to 9 and the like, as well as individual values of 5, 6, 7, 8, 9 and 10, and will also be understood to include any value between valid integers within the stated range, such as 5.5, 6.5, 7.5, 5.5 to 8.5, 6.5 to 9, and the like. Also, for example, the range of "10% to 30%" will be understood to include subranges, such as 10% to 15%, 12% to 18%, 20% to 30%, etc., as well as all integers including values of 10%, 11%, 12%, 13% and the like up to 30%, and will also be understood to include any value between valid integers within the stated range, such as 10.5%, 15.5%, 25.5%, and the like.

A conventional grinding wheel is made exclusively of steel and is heavy, so there is a problem in that the exchange time is increased due to the need to use a crane or a forklift when replacing the wheel, and the use of the grinding wheel made of steel is problematic in that cracking and fatigue failure occur due to burning on the surface of the material of, for example, a pin or journal.

Accordingly, the present inventors have made great efforts to solve the above problems and thus ascertained that a grinding wheel manufactured so as to include a wheel central part including a metal (steel) and a wheel outer peripheral part located on the outer surface of the wheel central part and configured such that a fiber-reinforced plastic (FRP) layer is provided at a position and thickness varying depending on the type of weaving pattern layer may exhibit superior vibration/shock absorption and offsetting effects compared to existing grinding wheels, so problems such as cracking and fatigue fracture due to burning may not occur, and moreover, the quality and productivity of processed products may be improved, and unlike existing grinding wheels, when the grinding part is completely consumed, it may be replaced with a new grinding part due to being removably attached, thus reducing the exchange time and the amount of tool wear, thereby culminating in the present disclosure.

FIG. 1 is a perspective view showing a grinding wheel 1 according to the present disclosure. With reference thereto, the grinding wheel includes a wheel central part 10 including steel, a wheel outer peripheral part 20 provided on the outer surface of the wheel central part and configured such that a fiber-reinforced plastic (FRP) layer is laminated and joined in a plurality of plies in a direction perpendicular to the outer surface of the wheel central part, and an abrasive part 30 provided on the outer surface of the wheel outer peripheral part and including an abrasive.

The fiber-reinforced plastic (FRP) layer is a layer including fiber-reinforced plastic (FRP), the fiber-reinforced plastic (FRP) is a kind of composite material, and the fiber is manufactured through a molding process using a matrix such as epoxy or polyamide. The type of fiber-reinforced plastic (FRP) may vary depending on the type of fiber that is used.

Specifically, the fiber-reinforced plastic (FRP) layer may include at least one selected from the group consisting of carbon-fiber-reinforced plastic (CFRP), glass-fiber-reinforced plastic (GFRP), and aramid-fiber-reinforced plastic (AFRP), depending on the type of fiber used, and does not include only a specific type, but preferably includes a carbon-fiber-reinforced plastic (CFRP), which is lightweight and has high strength and a large damping effect without the need for a mold, compared to existing materials.

The carbon-fiber-reinforced plastic (CFRP) is a kind of composite material produced from a carbon fiber through a molding process using a matrix of, for example, epoxy or polyamide, and has a weight corresponding to about 20% of the weight of iron and very good stiffness, and is thus useful for various end uses that require low weight and high strength, such as high-tech aircraft or warships, as well as various structural building materials.

The fiber-reinforced plastic (FRP) layer may have at least one weaving pattern layer selected from among a woven fabric layer and a unidirectional fabric layer, depending on the weaving pattern. Moreover, the fiber bundle of the fiber-reinforced plastic layer may be composed of 1 k to 24 k strands of yarn per ply, and preferably 3 k strands or 24 k strands of yarn per ply. Outside the above range, if the number of strands is too low, economic feasibility may decrease because the slitting process for separating fiber bundles increases, whereas if the number of strands is too high, the fiber bundles become large, so gaps such as air bubbles may occur between the bundles, and poor dimensional stability may result.

Specifically, the wheel outer peripheral part of the grinding wheel according to the present disclosure is configured such that the fiber-reinforced plastic (FRP) layer is laminated and joined in a plurality of plies, in lieu of steel, thereby lowering the total weight of the grinding wheel, and also, the wheel central part and the wheel outer peripheral part may be removably attached, so the exchange time may be reduced.

Figure 2:
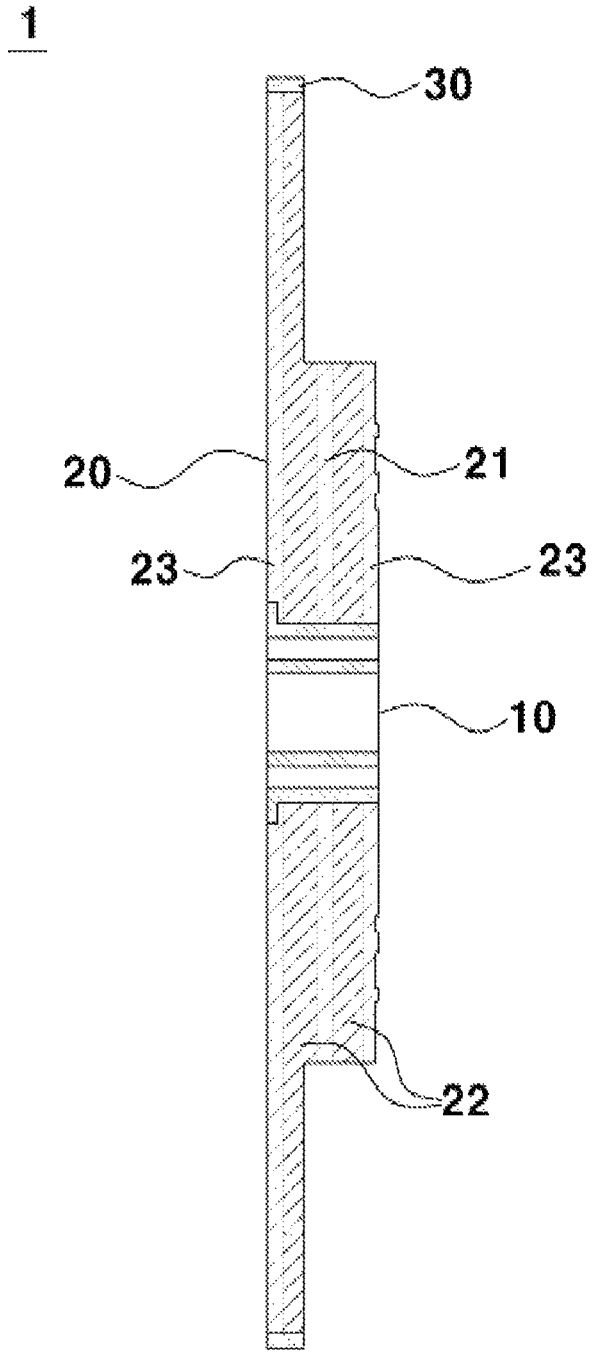
FIG. 2 is a cross-sectional view showing the inside of the grinding wheel according to the present disclosure.

FIG. 2 is a cross-sectional view showing the inside of the grinding wheel 1 according to the present disclosure. With reference thereto, the wheel central part 10 may be located at the center of the wheel, the wheel outer peripheral part 20 may be located on the outer surface of the wheel central part 10 and may be configured such that the fiber-reinforced plastic (FRP) layer is laminated and joined in a plurality of plies in a direction perpendicular to the outer surface of the wheel central part, and the abrasive part 30 may be located on the outer surface of the wheel outer peripheral part and may include an abrasive.

The wheel central part 10 is located at the center of the grinding wheel, includes steel, and is not particularly limited, so long as it is removably attached to the wheel outer peripheral part 20.

The steel included in the wheel central part 10 may be an alloy made by mixing iron and carbon.

The wheel central part may further include a bushing for fastening the grinding wheel 1 including the same with a grinding facility (not shown) and for compensating for the weak structure of internal shear stress of the grinding wheel (stress due to principal cutting force and radial force among cutting forces), and preferably further includes a bushing that is separable from the grinding wheel for replacement in case of internal deformation.

The bushing may have holes drilled at a predetermined interval in a circular shape in the surface thereof. The holes may be jig holes for balancing the wheel, and preferably serve to protect the portion that is bolted to a jig when balancing the wheel by inserting a metal insert (helical insert) for protecting the threaded portion of the bolt.

The wheel outer peripheral part 20 may be a composite layer provided on the outer surface of the wheel central part 10 and configured such that the fiber-reinforced plastic (FRP) layer is laminated and joined in a plurality of plies in a direction perpendicular to the outer surface of the wheel central part, and may be a wheel body accounting for most of the grinding wheel of the present disclosure.

Specifically, the wheel outer peripheral part 20 may be a composite layer in which a core portion 21, parallel to a line perpendicular to the outer surface of the wheel central part and located at the center of the wheel outer peripheral part, a middle portion 22, parallel to the core portion and located on at least one side of the core portion, and a surface portion 23, located on the middle portion, are laminated and joined.

The core portion 21 may be parallel to a line perpendicular to the outer surface of the wheel central part, may be located at the center of the wheel outer peripheral part, and is preferably a multilayer structure including a fiber-reinforced plastic (FRP) layer, particularly a woven fabric layer having a plurality of plies.

The woven fabric layer may be a woven fabric layer interlaced in 0° and 30° directions, 0° and 45° directions, 0° and 60° directions, or 0° and 90° directions, and is not limited to a woven fabric layer interlaced only in a specific direction but is preferably a woven fabric layer interlaced in 0° and 90° directions capable of being laminated (prepreg compression molding, PCM, or autoclave).

Preferably, the woven fabric layer is woven in a plain weave, a twill weave, or the like, depending on the weaving pattern, while being interlaced in 0° and 90° directions, but is not limited to including only a specific pattern, and is preferably woven in a plain weave, which is advantageous for dimensional stability.

The thickness in plies of the core portion 21 may be determined based on the specific thickness of each ply and the number of plies each having the specific thickness. Specifically, one ply may be 0.1 mm to 0.3 mm, preferably 0.2 mm to 0.26 mm, and more preferably 0.23 mm to 0.25 mm. Accordingly, the thickness in plies of the core portion depending on the thickness of one ply may be 1 to 20 plies, preferably 8 to 12 plies, and more preferably 9 to 11 plies.

The middle portion 22 may be parallel to the core portion, may be located on at least one side of the core portion, and is preferably located on both sides of the core portion.

The middle portion may be a multilayer structure including a fiber-reinforced plastic (FRP) layer, particularly a unidirectional fabric layer having a plurality of plies.

The unidirectional fabric layer may be a layer in which fibers are not interlaced but are disposed to face in one direction, and are arranged parallel to each other in one direction.

The unidirectional fabric layer structure may be configured such that the direction of fibers included in a first unidirectional fabric layer and the direction of fibers included in a second unidirectional fabric layer laminated on the first unidirectional fabric layer cross at an intersection angle to form a plurality of plies, and specifically, the intersection angle may be 0° to 180°, and is not limited to only a specific value in the formation of a plurality of plies, and preferably, the intersection angle is 85° to 95°, more preferably 87° to 93°, and still more preferably 89° to 91°. Since unidirectional fabric layers are laminated in the intersection angle range to form a plurality of plies, superior physical properties and low cost may result compared to when using woven fabrics.

Like the thickness in plies of the core portion, the thickness in plies of the middle portion 22 may be determined based on the specific thickness of each ply and the number of plies each having the specific thickness. Specifically, one ply may be 0.1 mm to 0.3 mm, preferably 0.2 mm to 0.26 mm, and more preferably 0.23 mm to 0.25 mm. Accordingly, the thickness in plies of the middle portion depending on the thickness of one ply may be 90 to 100 plies, preferably 93 to 98 plies, and more preferably 94 to 97 plies. Outside the above range, if the thickness in plies of the middle portion is too high, the molding cycle may increase and thus manufacturing costs may increase.

The surface portion 23 may be located on the middle portion, and is preferably located on each side of the middle portion.

The surface portion may be a multilayer structure including a fiber-reinforced plastic (FRP) layer, particularly a woven fabric layer having a plurality of plies.

The weaving direction and the weaving pattern of the woven fabric layer included in the surface portion may be the same as those described for the core portion.

Like the thickness in plies of the core portion, the thickness in plies of the surface portion 23 may be determined based on the specific thickness of each ply and the number of plies each having the specific thickness. Specifically, one ply may be 0.1 mm to 0.3 mm, preferably 0.2 mm to 0.26 mm, and more preferably 0.23 mm to 0.25 mm. Accordingly, the thickness in plies of the surface portion depending on the thickness of one ply may be 22 to 28 plies, and preferably 24 to 26 plies.

Specifically, in the grinding wheel according to the present disclosure, the fiber-reinforced plastic (FRP) layers in the wheel outer peripheral part located on the outer surface of the wheel central part are provided at different positions and thicknesses as described above depending on the weaving pattern, so the core portion, the middle portion and the surface portion are appropriately located. Thereby, vibration/shock absorption and offsetting effects may be improved compared to existing grinding wheels, problems such as cracking and fatigue fracture due to burning may not occur, and the quality and productivity of processed products may be increased.

The abrasive part 30 is located on the outer surface of the wheel outer peripheral part and has a predetermined thickness. Preferably, the abrasive part is located on the outer surface of the wheel outer peripheral part between the abrasive part and the wheel outer peripheral part using an adhesive.

The thickness of the abrasive part may be 3 T to 5.5 T, preferably 3 T to 5 T, more preferably 1.5 T to 2.5 T, and even more preferably 1.9 T to 2.1 T. Outside the above range, if the thickness is excessively high, damage may occur.

The abrasive part may include an abrasive, and the abrasive may include at least one selected from the group consisting of typical abrasives that may be used in the present disclosure, for example, CBN (cubic boron nitride), fused alumina, and silicon carbide, and is not limited to including only a specific component, but preferably includes CBN (cubic boron nitride) having superior high-temperature hardness, high abrasion resistance and high cutting speed and thus excellent workability.

The grit size of the abrasive may be 110 to 130 mesh, and preferably 115 to 125 mesh. Outside the above range, if the grit size is excessively small, roughness may be very high. On the other hand, if the grit size is excessively large, desired roughness may be obtained, but poor workability may result.

The concentration of the abrasive is a volume percentage indicating how much abrasive, that is, the abrasive grain (CBN), is contained therein. For example, a product containing 50 vol % of abrasive is represented as Concentration 200, and the concentration factor may be 8.8 Ct/cm-$^3$, and examples of the abrasive may include Concentration 175 (abrasive volume: 43.75, concentration factor: 7.7), Concentration 125 (abrasive volume: 37.5, concentration factor: 6.6), Concentration 100 (abrasive volume: 25, concentration factor: 4.4), Concentration 75 (abrasive volume: 18.75, concentration factor: 3.3), and Concentration 50 (abrasive volume: 12.5, concentration factor: 2.2). Here, the concentration of the abrasive may be 150 to 250, and preferably 190 to 210. Outside the above range, if the concentration is too low, quality problems may occur, whereas if the concentration is too high, workability problems may occur.

The grinding wheel according to the present disclosure satisfying the above configuration is a grinding wheel capable of grinding the pin or journal of a crank, and may be manufactured in any structure depending on the specification of the grinding wheel, the wheel size may be 750 to 430 D and 10 T to 100 T, and the wheel thickness in contact with the processing surface may be 30 U to 10 U.

The abrasive part in the grinding wheel according to the present disclosure satisfies the above characteristics, and not only primarily prevents damage to the grinding wheel, but also shortens the exchange time due to easy replacement through removable attachment when the abrasive part is damaged.

A better understanding of the present disclosure may be obtained through the following examples. These examples are merely set forth to illustrate the present disclosure, and are not to be construed as limiting the scope of the present disclosure.

Example—Grinding Wheel Having Weaving Pattern Layers (Plain Weave)

In order to manufacture a grinding wheel having weaving pattern layers, a high-temperature and high-pressure autoclave curing process was performed. Specifically, a grinding wheel (wheel size: 650D-50 T-5.5X-17U) having the following specifications was manufactured through a process of curing at a temperature of 80° C. for 180 minutes and at a temperature of 125° C. for 180 minutes at a pressure of 3.3 kgf/cm$^2$.

Specifically, a wheel central part included a separable/replaceable bearing made of steel including S45C.

In addition, a wheel outer peripheral part was provided on the outer surface of the wheel central part. Specifically, the wheel outer peripheral part was configured such that a core portion parallel to a line perpendicular to the outer surface of the wheel central part and located at the center of the wheel outer peripheral part, a middle portion parallel to the core portion and located on both sides of the core portion, and a surface portion located on the middle portion were laminated and joined.

All of fiber-reinforced plastic (FRP) layers were carbon-fiber-reinforced plastic (CFRP) layers, and the fiber bundle of each layer was composed of 3 k strands of yarn per ply.

The core portion was a multilayer structure including a fiber-reinforced plastic (FRP) layer, particularly a woven fabric layer having a plurality of plies. Specifically, the woven fabric layer was woven in a plain weave interlaced in 0° and 90° directions (WSN3KP 200YS FAW (fiber area weight) −200 g/m$^2$, RC (resin content) −40%), and the thickness in plies thereof was 10 plies (1 ply: 0.244 mm, 3K).

The middle portion was a multilayer structure including a fiber-reinforced plastic (FRP) layer, particularly a unidirectional fabric layer having a plurality of plies.

Specifically, unidirectional fabric layers were laminated at an intersection angle of 90° (UD→USN300A, FAW-300 g/m$^2$, RC-36%), and the thickness in plies thereof was 95 plies (1 ply: 0.244 mm, 3K).

The surface portion was a multilayer structure including a fiber-reinforced plastic (FRP) layer, particularly a woven fabric layer having a plurality of plies. Specifically, the woven fabric layer was woven in a plain weave interlaced in 0° and 90° directions (WSN3KP 200YS FAW-200 g/m2, RC-40%), and the thickness in plies thereof was 25 plies (1 ply: 0.244 mm, 3K).

The abrasive part was located at a thickness of 2 T using an adhesive on the outer surface of the wheel outer peripheral part. The abrasive included in the abrasive part was CBN (cubic boron nitride), the grit size of the abrasive was 120 mesh, and the concentration thereof was 200.

Comparative Example 1—Grinding Wheel Having Weaving Pattern Layers (Twill Weave)

A grinding wheel was manufactured in the same manner as in Example 1, with the exception that the woven fabric layers included in the core portion and the surface portion of the wheel outer peripheral part were woven in a twill weave interlaced in 0° and 90° directions, in contrast with Example 1.

Comparative Example 2—Grinding Wheel Having Only One Weaving Pattern Layer

A grinding wheel was manufactured in the same manner as in Example 1, with the exception that a woven fabric layer woven in a twill weave interlaced in 0° and 90° directions was used for the whole structure of the wheel outer peripheral part, in contrast with Example 1.

Comparative Example 3—Grinding Wheel Including Aluminum

A grinding wheel including aluminum (6061 T4) in which the wheel central part and the wheel outer peripheral part were integrated was prepared, unlike Example 1.

Comparative Example 4—Grinding Wheel Including Steel

A grinding wheel including steel (S45C) in which the wheel central part and the wheel outer peripheral part were integrated was prepared.

Comparative Example 5—Grinding Wheel Having Different Laminate Structure

A grinding wheel was manufactured in the same manner as in Example 1, with the exception that the wheel outer peripheral part was formed by combining a woven fabric layer in a plain weave interlaced in 0° and 90° directions with a woven fabric layer in a twill weave interlaced in 0° and 90° directions, in which the thickness in plies was 15 plies, in contrast with Example 1.

Comparative Example 6—Grinding Wheel Having Different Laminate Structure

A grinding wheel was manufactured in the same manner as in Example 1, with the exception that the wheel outer peripheral part was formed by alternately stacking 7 woven fabric layer plies interlaced in 0° and 45° directions and 8 woven fabric layer plies interlaced in 0° and 90° directions, in which the thickness in plies was 15 plies, in contrast with Example 1.

Comparative Example 7—Grinding Wheel Having Different Laminate Structure

A grinding wheel was manufactured in the same manner as in Example 1, with the exception that the surface portion of the wheel outer peripheral part was formed of 3 woven fabric layer plies interlaced in 0° and 90° directions, the core portion was formed of 3 woven fabric layer plies interlaced in 0° and 90° directions, and 9 unidirectional fabric layer plies of the middle portion were sequentially laminated at respective intersection angles of 0/20/40/60/80/−80/−60/−40/−20°, in contrast with Example 1.

Analysis of Physical Properties

Density (g/cm$^3$): measured using AUTOMATIC DENSITY METER

Tensile strength (MPa): measured using UTM (Universal testing machine)

Damping coefficient: measured under dynamic mechanical analysis (DMA) conditions for measuring a material's response to stress or strain in the form of DMA sinusoidal oscillation (test conditions: frequency: 1 Hz, temperature: 30° C., amplitude: 10 μm) No unit. Steel: <0.0001, Al: 0.000187.

Tensile stiffness (GPa): measured using UTM (Universal testing machine)

Spindle load: monitored through load measurement during processing in processing facility Parallelism (μm): Hommel-Etamic GmbH unit Cylindricity (μm): Hommel-Etamic GmbH unit Roundness (μm): Hommel-Etamic GmbH unit Flatness (μm): Hommel-Etamic GmbH unit Roughness (μm): Hommel-Etamic GmbH unit Burning test: performed using an optical microscope Test Example 1—Test of Physical Properties of Grinding Wheel The grinding wheels according to Examples and Comparative Examples 1 to 4 were manufactured, and the physical properties thereof were tested. The results thereof are shown in Table 1 below.

TABLE 1

| Classification | Comparative Example 4 | Comparative Example 3 | Comparative Example 2 | Comparative Example 1 | Example |
|---|---|---|---|---|---|
| Density (g/cm$^3$) | 7.856 | 2.736 | 1.504 | 1.545 | 1.545 |
| Tensile strength (MPa) | 560 (yield) | 145 (yield) | 670 | 854 | 930 |
| Damping coefficient | Resolution <0.0001 | 0.000187 | 0.00190 | 0.0027 | 0.00301 |

As is apparent from Table 1, the grinding wheel according to Example 1 was high in both tensile strength and damping coefficient, which is related to a damping effect, despite the low density thereof, compared to the grinding wheels according to Comparative Examples 1 to 4. In particular, it was confirmed that both the tensile strength and the damping coefficient were higher than those of the grinding wheel having a twill weave structure according to Comparative Example 1. Also, the grinding wheels according to Example and Comparative Examples 5 to 7 were manufactured, and the physical properties thereof were tested. The results thereof are shown in Table 2 below.

TABLE 2

| Classification | Tensile stiffness (GPa) | Tensile strength (MPa) | Tensile elongation (%) | Manufacturing process | Cost (for raw material) |
|---|---|---|---|---|---|
| Comparative Example 5 | 59 | 725.3 | 1.16 | Easy | about 10 million |
| Comparative Example 6 | 41.6 | 504.7 | 1.18 | Medium | about 10 million |
| Comparative Example 7 | 44.6 | 546 | 1.2 | Hard | about 6 million |
| Example | 64.5 | 1.154 | — | Easy | about 7 million |

*Pin grinding wheel size: 50 T standard, about 260 plies required for manufacturing & lamination (1 ply=0.288)

As is apparent from Table 2, for the grinding wheel according to Example, in which the woven fabric layers in the core portion and the surface portion inside the wheel outer peripheral part were interlaced in 0° and 90° directions and the unidirectional fabric layers of the middle portion were laminated at an intersection angle of 90°, the manufacturing process was simple, the cost was low, and the mechanical properties such as tensile stiffness, tensile strength and the like thereof were superior, compared to the grinding wheels according to Comparative Examples 5 to 7, which did not adopt the lamination direction described above.

Specifically, in the grinding wheel according to the present disclosure, the fiber-reinforced plastic (FRP) layers in the wheel outer peripheral part located on the outer surface of the wheel central part were provided at different positions and thicknesses depending on the weaving pattern, thereby exhibiting superior vibration/shock absorption and offsetting effects and superior mechanical properties compared to conventional grinding wheels.

Test Example 2—Test of Quality of Processed Product Using Grinding Wheel

The grinding wheels according to Example and Comparative Example 4 were manufactured, and the quality of processed products subjected to crank processing using the grinding wheel was tested. The results thereof are shown in Tables 3 and 4 below.

TABLE 3

| | | Comparative Example 4 | | Example | | |
|---|---|---|---|---|---|---|
| Classification | Spec | A type | B type | A type | B type | Effect |
| Spindle load | — | 44A | 45A · max | 34A | 45A · max | Improved |
| Parallelism | 5 μm ↓ | ~0.8 | 0.2-0.4 | 1.1-1.5 | 0-0.8 | Within spec |
| Cylindricity | 5 μm ↓ | ~2.8 | 2.9-3.4 | 2.8-3.7 | 2.6-3.6 | |
| Roundness | 5 μm ↓ | ~1.9 | 1.2-2.0 | 1.5-2.0 | 1.3-2.2 | |
| Flatness | 5 μm ↓ | — | 0.14-0.16 | 2.0-2.73 | 2.0-2.2 | |
| Roughness | 5 μm ↓ | — | 2.63-2.84 | 1.86-2.2 | 2.56-2.82 | |
| Burning test | | Pass | Some occurrence | Pass | Pass | |

*(Difference in material of crank) A type made of FCD45C, and B type made of 44MnsiVS6

TABLE 4

| | Amount of production (36 days, three facilities) | | Wheel/abrasive part (CBN) thickness (mm) | | Amount of wear of abrasive (CBN) in abrasive part (mm) | |
|---|---|---|---|---|---|---|
| Classification | Total | One facility | Before | After | Total amount of wear | Amount of wear of each facility |
| Example | 24.667 | 8.222 | 647.78 | 646.31 | 1.46 | 0.026 |
| Comparative Example 4 | 7.239 | 2.413 | 648.63 | 646.3 | 2.29 | 0.089 |

As is apparent from Table 3, in the processed product manufactured using the grinding wheel according to Example, the spindle load was reduced, burning did not occur during the burning test, and the specifications of the processed product, such as parallelism and the like, also satisfied the desired ranges, unlike the processed product manufactured using the grinding wheel according to Comparative Example 4. Also, as is apparent from Table 4, in the processed product manufactured using the grinding wheel according to Example, the amount of wheel tool wear, that is, the amount of wear of the abrasive (CBN) in the abrasive part (mm), was decreased by about 81%, compared to the processed product manufactured using the grinding wheel according to Comparative Example 4. This was deemed to be because the damping coefficient of the grinding wheel according to Example in Test Example 1 was high, and thus a difference in the processing shock absorption due to the damping effect was greater.

Therefore, the grinding wheel according to the present disclosure is configured such that the fiber-reinforced plastic (FRP) layer in the wheel outer peripheral part located on the outer surface of the wheel central part is provided at a position and thickness that vary depending on the type of weaving pattern layer, thereby exhibiting superior mechanical properties and superior vibration/shock absorption and offsetting effects compared to conventional grinding wheels, so problems such as cracking and fatigue failure due to burning do not occur, and moreover, the quality and productivity of processed products can be improved. Moreover, the grinding wheel of the present disclosure is lighter in weight than conventional grinding wheels, and the abrasive part or the wheel outer peripheral part can be removably attached, thus reducing the exchange time and the amount of tool wear.

The present disclosure has been described in detail with reference to preferred embodiments thereof. However, it will be appreciated by those skilled in the art that changes may be made in these embodiments without departing from the principles or spirit of the disclosure, the scope of which is defined in the appended claims and their equivalents.

What is claimed is:

1. A grinding wheel, comprising:

a wheel central part comprising steel; and a wheel outer peripheral part provided on an outer surface of the wheel central part and configured such that a fiber-reinforced plastic (FRP) layer is laminated and joined in a plurality of plies in a direction perpendicular to the outer surface of the wheel central part, wherein the fiber-reinforced plastic (FRP) layer has at least one weaving pattern layer selected from among a woven fabric layer and a unidirectional fabric layer, and wherein the wheel outer peripheral part is configured such that a core portion parallel to a line perpendicular to the outer surface of the wheel central part and located at a center of the wheel outer peripheral part, a middle portion parallel to the core portion and located on at least one side of the core portion, and a surface portion located on the middle portion are laminated and joined.

2. The grinding wheel of claim 1, wherein the fiber-reinforced plastic layer comprises at least one selected from the group consisting of carbon-fiber-reinforced plastic (CFRP), glass-fiber-reinforced plastic (GFRP), and aramid-fiber-reinforced plastic (AFRP).

3. The grinding wheel of claim 1, wherein a fiber bundle of the fiber-reinforced plastic layer comprises 1 k to 24 k strands of yarn per ply.

4. The grinding wheel of claim 1, wherein each of the core portion and the surface portion comprises a woven fabric layer having a plurality of plies.

5. The grinding wheel of claim 4, wherein a thickness in plies of the core portion is 8 to 12 plies.

6. The grinding wheel of claim 4, wherein a thickness in plies of the surface portion is 22 to 28 plies.

7. The grinding wheel of claim 4, wherein the woven fabric layer is a woven fabric layer interlaced in 0° and 90° directions.

8. The grinding wheel of claim 1, wherein the woven fabric layer is woven in a plain weave.

9. The grinding wheel of claim 1, wherein the middle portion comprises a unidirectional fabric layer having a plurality of plies.

10. The grinding wheel of claim 9, wherein a thickness in plies of the unidirectional fabric layer is 90 to 100 plies.

11. The grinding wheel of claim 9, wherein the unidirectional fabric layer is laminated at an intersection angle of 85° to 95° to form a plurality of plies.

12. The grinding wheel of claim 1, further comprising an abrasive part provided on an outer surface of the wheel outer peripheral part and comprising an abrasive.

* * * * *